US006739225B2

(12) United States Patent
Bader et al.

(10) Patent No.: US 6,739,225 B2
(45) Date of Patent: May 25, 2004

(54) SCREW DRIVING TOOL

(75) Inventors: Thomas Bader, Landsberg (DE); Gerd Daubinger, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/319,704

(22) Filed: Dec. 12, 2002

(65) Prior Publication Data

US 2003/0110910 A1 Jun. 19, 2003

(30) Foreign Application Priority Data

Dec. 13, 2001 (DE) ..... 101 61 356

(51) Int. Cl.[7] ..... B25B 23/157
(52) U.S. Cl. ..... 81/475; 173/178
(58) Field of Search ..... 81/475, 429, 467, 81/469, 473; 173/176, 178, 216

(56) References Cited

U.S. PATENT DOCUMENTS 4,913,242 A * 4/1990 Lo ..... 173/178
4,966,057 A * 10/1990 Koppatsch ..... 81/469
5,538,089 A * 7/1996 Sanford ..... 173/2
6,076,438 A * 6/2000 Rahm ..... 81/473

* cited by examiner

*Primary Examiner*—Joseph J. Hail, III
*Assistant Examiner*—David B. Thomas
(74) *Attorney, Agent, or Firm*—Sidley Austin Brown & Wood, LLP

(57) ABSTRACT

A screw driving tool comprises a housing (1), a drive (2), a drive spindle (3), a torque coupling (4) between the drive (2) and the drive spindle (3), as well as an adjustment mechanism disposed between the free end of the drive spindle (3) and the torque coupling (4), the adjustment mechanism is used for adjusting the torque transmitted using the torque coupling (4). The adjustment mechanism has at least one prestressable spring element (5) cooperating with the torque coupling; a compression sleeve (6) that is displaceable parallel to the axis of the drive spindle (3) and cooperating with the spring element (5); a control sleeve (7) arranged coaxially with the compression sleeve (6) and cooperating with the compression sleeve (6); a rotatable adjustment sleeve (8), and a plurality of rotationally mounted planet wheels (10) cooperating in a form locked manner with the control sleeve (7) and inner teeth (9) of the adjustment sleeve (8). The housing (1) extends between the control sleeve (7) and the adjustment sleeve (8) and the planet wheels (10) are rotationally mounted in passage openings in the housing (1).

6 Claims, 3 Drawing Sheets

SCREW DRIVING TOOL

BACKGROUND OF THE INVENTION

The invention relates to a screw driving tool where a housing extends between a control sleeve and an adjustment sleeve with the control sleeve and housing joined by a threaded connection and planet wheels rotationally mounted in passages in the housing.

Driving tools are used for driving screws into a workpiece or target material in which a torque coupling is arranged in the drive line between the drive motor and the drive spindle. The level of torque that can be transmitted using the torque coupling can be adjusted with the aid of a mechanical adjustment mechanism. Such a driving tool is known from DE 299 18 610 U1. The adjustment mechanism of this screw driving tool has at least one prestressable spring co-operating with the torque coupling; a control sleeve arranged coaxially to a pressure sleeve and cooperating with the pressure sleeve; a rotatable adjustment sleeve, and a plurality of rotatably mounted planet wheels cooperating in a form locking manner with the inner toothing of the adjustment sleeve. These planet wheels exhibit a dentate or toothed configuration and are rotatably mounted on corresponding studs that project from the control sleeve in the working direction.

The pressure sleeve and the control sleeve disclosed in DE 299 18 610 U1, which exhibit the studs for the planet wheels cannot be economically manufactured. In addition, this driving tool does not have a receiving part at which, for example, an extension rod or a screw feeder device can be fastened in a form locked manner.

SUMMARY OF THE INVENTION

The object of the invention is to provide a driving tool that can be economically manufactured and has a receiving part at which an accessory device such as for example, an extension rod or a screw feeder device which can be form lockingly fastened.

The housing and the control sleeve of the screw driving or setting tool, according to the invention can be economically manufactured by virtue of its substantially sleeve-like form. The control sleeve has an outer contour adapted to one portion of the inner contour of the housing and an outer thread that is matched to an inner thread of the housing. The rotationally mounted planet wheels in passage openings project from the wall of the housing on both sides and cooperate on the one hand with the setting sleeve on the outer side of the housing and with the control sleeve on the inner side.

In order to enable an accessory device or adapter to be affixed to the housing of the driving tool, the housing advantageously has a receiving part projecting outwardly from the setting direction end of the adjustment sleeve facing in the setting direction. The accessory device or adapter, for example, can be an extension rod or a screw feeder device.

At least one locking contour arranged, for example, on the outer contour of the receiving part expediently serves in the attachment of the accessory device or adapter relative to the housing in the axial direction and/or against rotation.

The locking contour encircles the receiving part preferably partially or completely in the form of a peripheral groove.

The planet wheels arranged between the setting sleeve and the control sleeve appropriately exhibit a dentate or toothed shape so that they can cooperate in a form locked manner with an external toothing of the control sleeve and an inner toothing of the setting sleeve. With a rotation of the setting sleeve the control sleeve is rotated in an opposite direction to that of the setting sleeve.

The control sleeve is axially displaceable on rotating the setting sleeve using the threaded connection between the housing and the control sleeve. When this is done, the external toothing disposed on the control sleeve moves relative to the planet wheels rotationally arranged in the housing. In order to assure that they cooperate completely with the external toothing of the control sleeve, even in the event of maximal displacement of the control sleeve, the length of the external toothing of the control sleeve measured parallel to the axis of the drive spindle is preferably greater than that of the extent of one of the planet wheels measured in the same direction.

BRIEF DESCRIPTION OF THE DRAWING

The invention will be more completely explained using an exemplary embodiment read together with the drawings, wherein.

DESCRIPTION OF THE PREFERRED EMBODIMENTS

Figure 1:
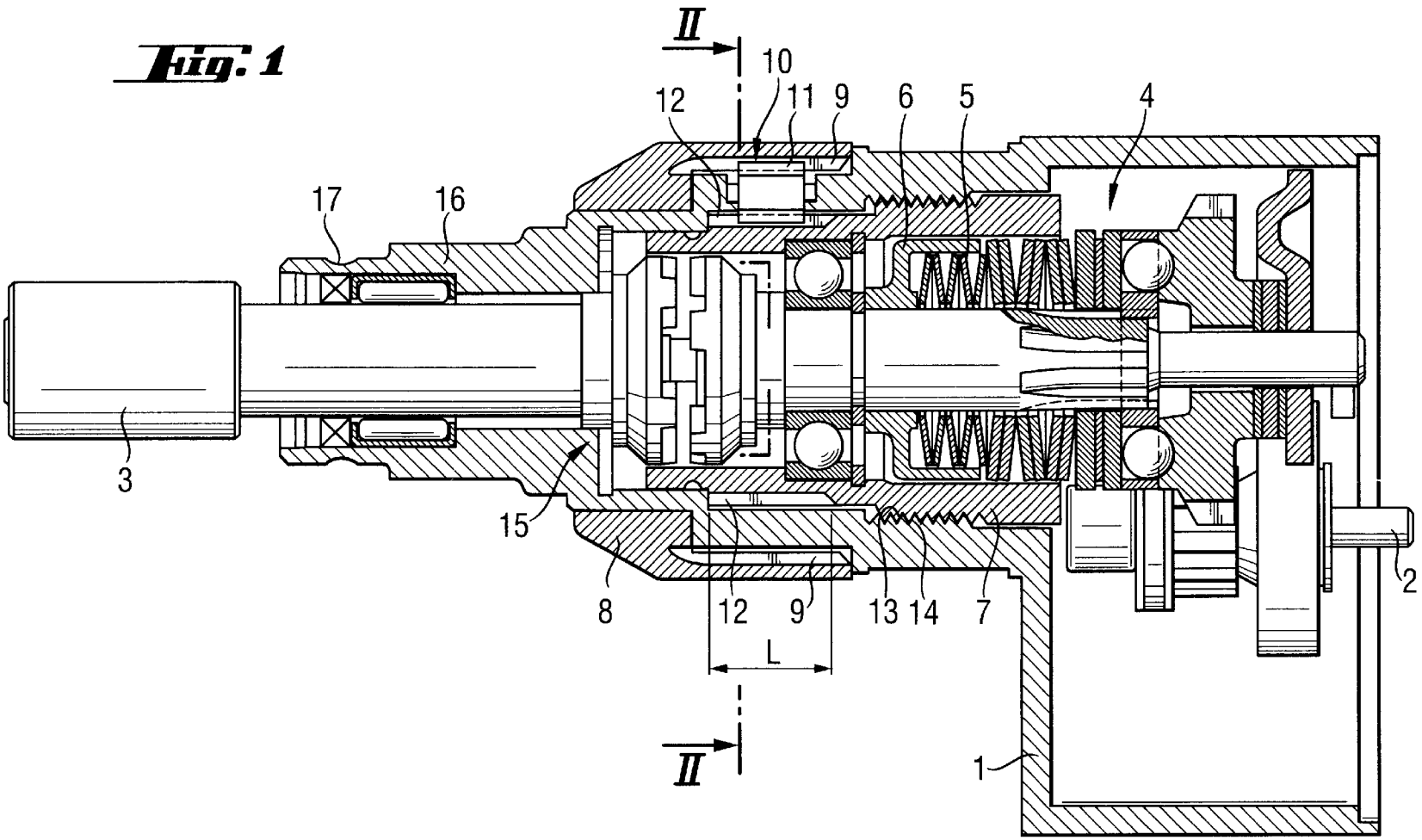
FIG. 1 is an axially extending working end zone of a screw driving tool according to the invention in a sectional view.
Figure 2:
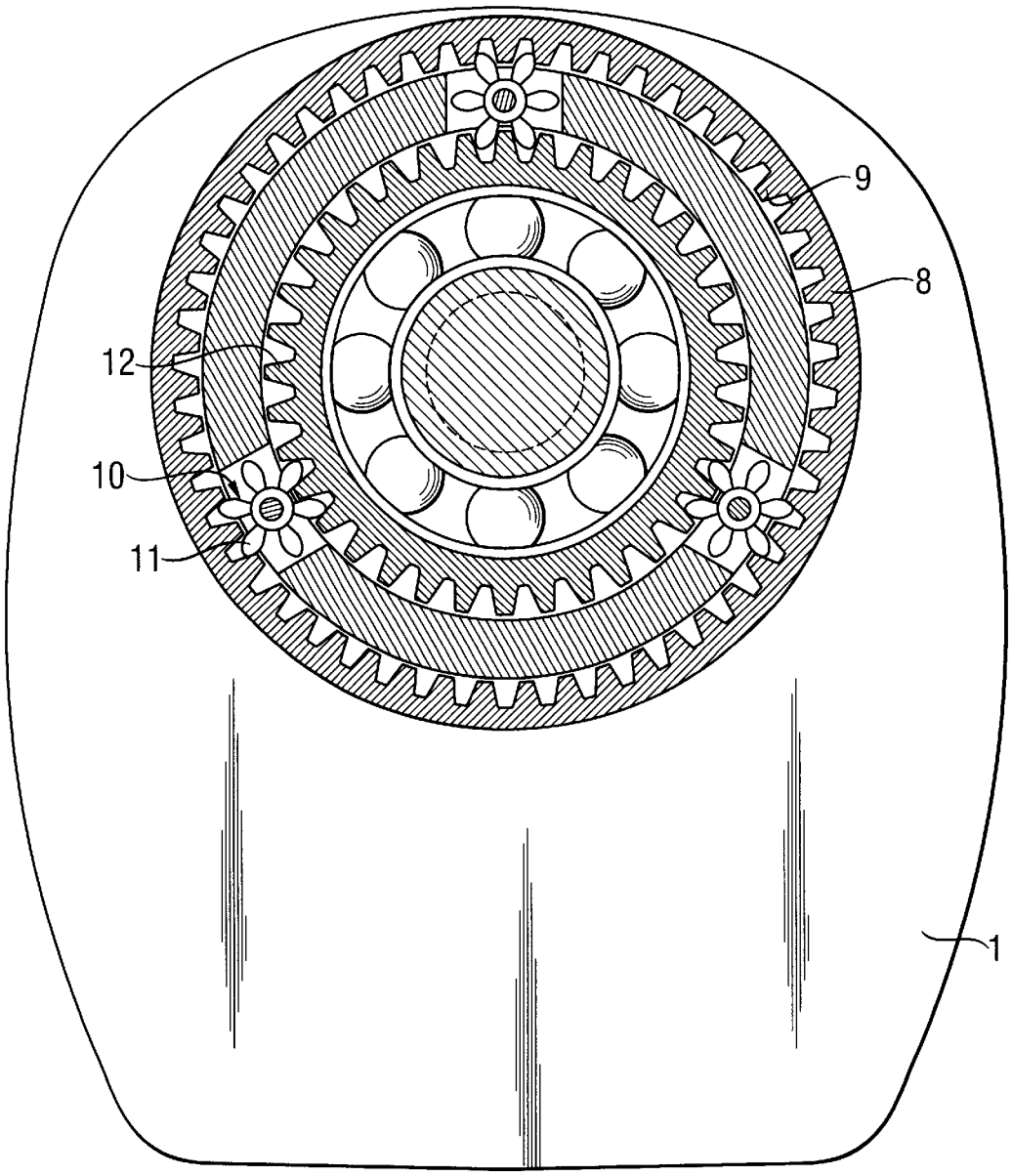
FIG. 2 is a section through the screw driving device according to FIG. 1 taken along the line II—II.

The screw driving tool partially shown in FIG. 1 comprises an axially extending housing 1, a drive 2 in a trailing end of the housing, an axially extending drive spindle 3 projecting from front of the housing, a mechanical torque coupling 4 positioned between the drive 2 and the drive spindle 3, as well as an adjusting mechanism disposed between the free end of the drive spindle 3 and the torque coupling 4, with which the torque translated using the torque coupling 4 can be adjusted. The drive spindle 3 is comprised of the two spindle halves that form-lockingly cooperate with the aid of a claw coupling 15 upon pressing the driving tool against a workpiece or target material surface, (not shown herein). The drive 2 is connected with a drive motor (not shown herein). The mechanical torque coupling 4 is comprised of two mutually rotatable coupling halves arranged coaxially relative to each other and a plurality of spherical transmission elements arranged between the coupling halves. The two coupling halves exhibit on their mutual facing sides a number of recesses corresponding to the number of transmission elements, into which the transmission elements project.

A first coupling half facing away from the working direction is coaxially fixedly and rotatably disposed in the housing 1. Before exceeding a limit torque there is a mutual turning of the two coupling halves, whereby the transmission elements attempt to slip out of their recesses and urge the second coupling half against the force of a spring element 5 in the working direction until they no longer project into the recesses and a turning of the first coupling half relative to the second coupling half is effected.

The spring element 5 is a part of the adjustment mechanism in which the level of the torque that can be transmitted by the torque coupling 4 can be adjusted. In addition to the spring element 5 a compression sleeve 6, a control sleeve 7, an adjustment sleeve 8 and a plurality of planet wheels 10 are associated with the adjustment mechanism. The compression sleeve 6 can be displaced parallel to the axis of the drive spindle 3 and cooperates directly with the spring element 5. A control sleeve 7 is disposed coaxially to the compression sleeve 6, which cooperates form-lockingly over an outer thread 14 with an inner thread 13 of the housing 1. A working-side end zone of the control sleeve 7 has on the outer side an external toothing 12 extending over the entire periphery of the control sleeve 7. A working-side portion of the housing 1 is enclosed by adjustment sleeve 8 that can be rotated relative to the housing 1 and whose inner wall is at least partially provided with an inner toothing 9. The axial fixing of the adjustment sleeve 8 on the housing is done, for example, by means of a detachable snap-on connection. By means of locking means (not shown herein) that are disposed between the adjustment sleeve 8 and the housing 1, for example, an auto-rotation of the adjustment sleeve 8 relative to the housing 1 is prevented.

Figure 3:
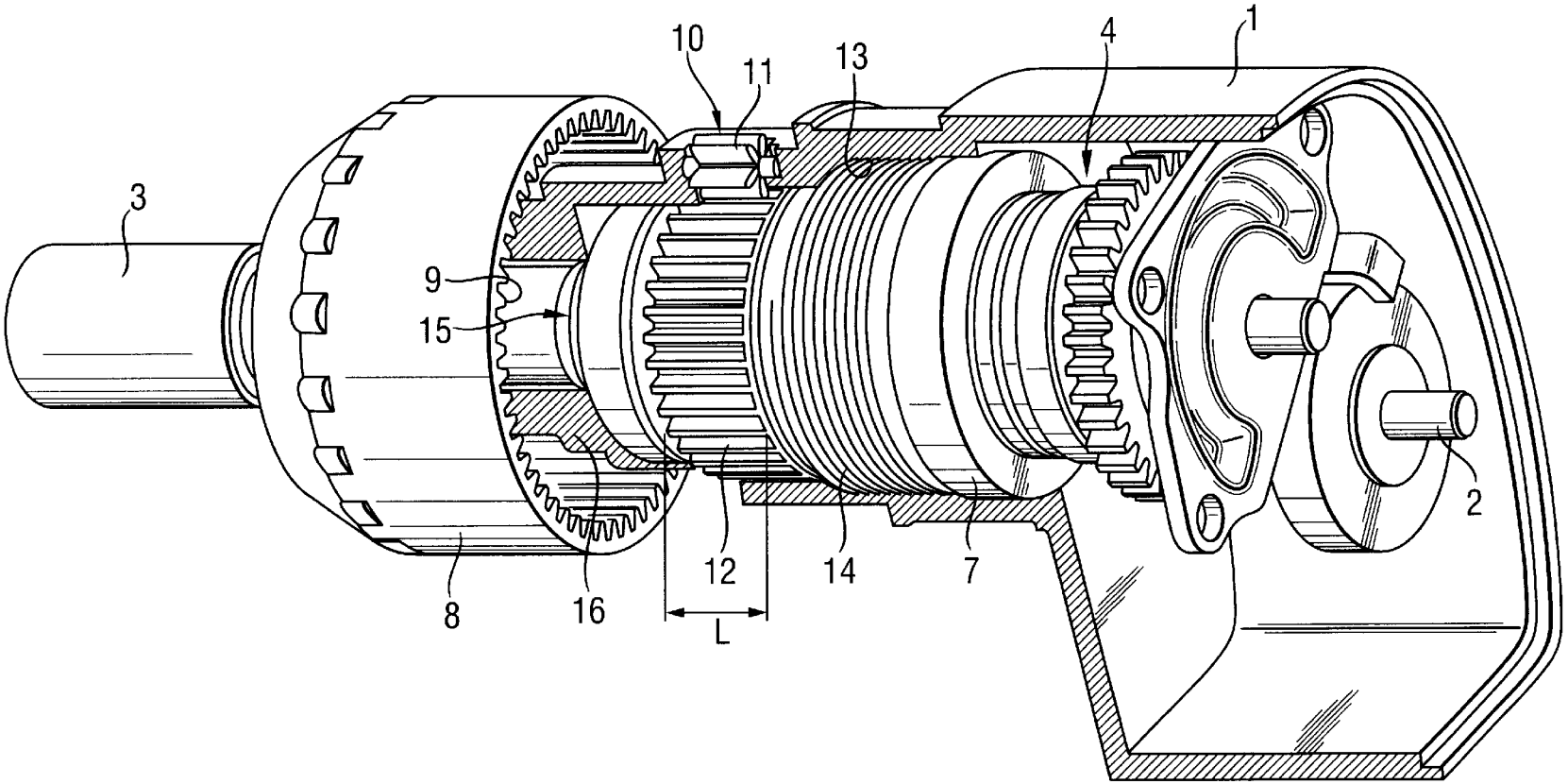
FIG. 3 is a three-dimensional sectional representation of the region of the screw driving tool represented in FIG. 1.

In the area of the inner toothing 9 the housing has a plurality of passage openings, in each of which a planet wheel 10 having a toothed configuration 11 is rotatably mounted. The screw driving tool according to the invention exhibits three planet wheels 10, for example, uniformly spaced around the housing 1, which cooperate in a form locked manner with the inner toothing 9 of the adjustment sleeve 8 and with the outer toothing 12 of the control sleeve 7. Only one of the three planet wheels is shown in FIGS. 1 and 3.

Adjustment of the target torque to be transmitted by the torque coupling 4 is achieved by turning the adjustment sleeve 8 relative to the housing 1. The rotary movement of the adjustment sleeve 8 is translated via the planet wheels 10 is such a fashion to the control sleeve 7, that the latter turns in a counter-rotating direction relative to the adjustment sleeve. The control sleeve 7, which is in contact with the housing 1 by way of a threaded connection, is axially displaced relative to the housing 1 by such turning. So that the planet wheels 10 regardless of the position of the control sleeve 7 can constantly completely project into the outer toothing 12 of the control sleeve 7, the length L, measured parallel to the axis of the drive spindle, of the outer toothing 12 of the control sleeve 7 is greater than the extent of one of the planet wheels 10 measured in the same direction.

Depending on the direction of rotation, the control sleeve 7 moves either towards the torque coupling 4 or away from it. With this axial displacement of the control sleeve 7, a corresponding axial displacement of the compression sleeve 6 cooperating with the spring element 5 is likewise achieved. A torque that is higher than that which can be transmitted by the torque coupling is then attained, for example, when the control sleeve 7 and the compression sleeve 6 are moved closer to the torque coupling 4 and thereby increasingly prestressing the spring element 5.

As can be seen especially in FIG. 1, part of the housing 1 projecting axially from the adjustment sleeve 8 in the working direction has a receiving part 16, which serves to receive and guide an accessory device or adapter (not shown herein). The accessory device or adapter can be, for example, an extension rod or a screw feeder device. The receiving part 16 has a circumferential extending locking contour 17 enclosing the receiving part 16, the contour being shaped in the form of an enclosing groove.

Both the adjustment sleeve 8, the control sleeve 7 and the planet wheels 10 are subjected to low loads relative to the transmitted forces and, accordingly, can be cost-effectively manufactured out of plastic using an injection molding process.

What is claimed is:

1. A screw driving tool comprises a housing having an elongated direction a front end and a rear end, a drive (2) located within said housing adjacent the rear end thereof, a drive spindle (3) with in said housing and having an axis extending in the elongated direction thereof, said drive spindle (3) having a free end located outwardly of the front end of said housing, a torque coupling (4) within said housing and extending between said drive (2) and said drive spindle (3), an adjustment mechanism (8) positioned in said housing between the free end of said drive spindle (3) and said torque coupling (4), said adjustment mechanism (8) adjusts the torque transmitted by said torque coupling (4), said adjustment mechanism comprises at least one axially extending prestressable spring element (5) cooperating with said torque coupling, a compression sleeve (6) to extending around and parallel to the axis of said drive spindle and in contact with said spring element (5), said compression sleeve (6) is displaceable in the axial direction of said drive spindle (3), a control sleeve (7) arranged coaxial with and enclosing said compression sleeve (6), said adjustment mechanism comprises an axially extending adjustment sleeve (8) rotatable about said drive spindle axis, a plurality of rotatable planet (10) wheels mounted in said housing (1) having teeth (11) thereon and in form locked cooperating engagement with said control sleeve and inner teeth (9) of said adjustment sleeve (8), said housing (1) extends between said control sleeve (7) and said adjustment sleeve (8), said control sleeve (7) and said housing (1) disposed in form locked contact via a thread connection, and said planet wheels mounted in passage openings in the axially extending region of said adjustment sleeve (8) in said housing (1).

2. A screw driving tool, as set forth in claim 1, wherein said housing (1) has an axially extending receiving part (16) projecting from said adjustment sleeve (8) towards a front end of said drive spindle (3).

3. A screw driving tool, as set forth in claim 2, wherein said receiving part (16) has at least one locking contour (17) thereon.

4. A screw driving tool, as set forth in claim 3, wherein said locking contour (17) at least partially surrounds said receiving part (16).

5. A screw driving tool, as set forth in claim 4, wherein said locking contour is a circumferentially extending groove formed in an outer periphery of said receiving part (16).

6. A screw driving tool, as set forth in claim 1, wherein said planet wheels (10) engage in a form locked manner with teeth (12) on an outer surface of said control sleeve (7).

* * * * *